United States Patent [19]

Cantrell

[11] 4,152,018

[45] May 1, 1979

[54] WINDOW SECURITY MEANS

[75] Inventor: Randy J. Cantrell, Rte. 2, 19 Woodridge, Plainfield, Ind. 46168

[73] Assignees: Randy J. Cantrell, Plainfield, Ind.; Robert L. Barnes, Bargersville, Ind.

[21] Appl. No.: 858,244

[22] Filed: Dec. 7, 1977

[51] Int. Cl.[2] ..... E05C 17/30

[52] U.S. Cl. ..... 292/305

[58] Field of Search ..... 292/346, 305, 306, 262, 292/275, 276, DIG. 2

[56] References Cited

U.S. PATENT DOCUMENTS

| | | | |
|---|---|---|---|
| 1,601,524 | 9/1926 | Gibbons | 292/305 |
| 2,793,064 | 5/1957 | Budoff | 292/288 |
| 2,837,905 | 6/1958 | Wroughton | 292/251 X |
| 2,912,268 | 11/1959 | Markovich | 292/262 |
| 3,606,421 | 9/1971 | Reichenbach | 292/1 |
| 3,837,191 | 9/1974 | Soiderer | 292/346 |

*Primary Examiner*—Richard E. Moore

*Attorney, Agent, or Firm*—Jenkins, Coffey & Hyland

[57] ABSTRACT

A window security means for double hung casement windows includes a lower tube, open at its upper end and having a metal box rigidly fastened to its lower end, with the box being open at its bottom and shaped to fit over the window lock on one movable part of the window. An upper tube is telescoped within the lower tube and adapted at its upper end to engage another movable part of the window. A fastener is provided to fasten the upper tube immovably within the lower tube, and a shield can surround the fastener and limit access to the fastener to access essentially from one direction.

9 Claims, 4 Drawing Figures

WINDOW SECURITY MEANS

This invention relates to an improved window security means for windows that open and close by sliding sashes, and particularly for double hung casement type windows.

A number of different kinds of windows include two or more sashes that slide in opposite directions within a window frame. Perphaps the most common of these is the so-called double hung casement window. It is frequently advisable to protect such windows by preventing them from being opened from the outside.

A variety of window security means have been proposed in the art, as for example, in U.S. Pat. Nos. 1,360,628; 1,811,681; 2,912,268; 3,136,290; and 3,512,821. In addition, protective enclosures for window locks have also been proposed, as for example, in U.S. Pat. Nos. 1,956,731 and 2,584,575. None of these prior security means provided in a single easily installed unit, complete security against opening the window.

This invention provides security against the opening of windows having sliding sashes in a convenient and easily installed assembly. The window security means of this invention includes a plurality of interfitting and interlocking bars with a fastener to lock the bars in a fixed position and an enclosure for the window lock adapted to fit over and prevent access to the lock. Such a window security means can include a lower tube open at its upper end and having a metal box rigidly fastened at its lower end, the box being open at its bottom and shaped to fit over the window lock on a movable sash of the window. An upper tube is telescoped within the lower tube and adapted at its upper end to engage another sash of the window. Fastening means fasten the upper tube immovably within the lower tube. A shield can surround the fastening means and be carried on one side of the lower tube. The metal box can be fitted to the window lock to prevent rotation of the lower tube, and access to the fastening means can be limited from outside the window when the window retainer is fitted to a window. Such window security means, when installed in engagement with the sliding sashes of such windows, can prevent the sashes from being opened and prevent access to the window lock.

Further features and advantages of the invention will be readily apparent from the following description and drawings in which.

It is frequently desirable to secure windows like double hung casement windows to prevent them from being opened from either the inside or the outside and to prevent opening of the top sash and the bottom sash. This invention provides security against the opening of windows having sliding sashes, like double hung casement windows, and intrusion from outside by means of such opening.

Figure 1:
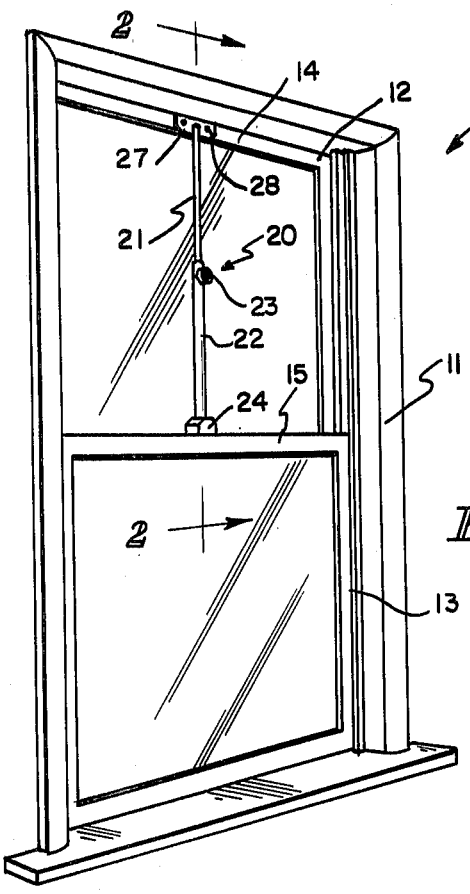
FIG. 1 is a perspective view of a window illustrating the window security means installed.

A conventional double hung casement window 10 is shown in FIG. 1. Such windows include a frame 11 in which an upper sash 12 and a lower sash 13 slide in opposite directions in order that the window may be opened and closed. FIG. 1 shows a security means of this invention 20 installed in the window 10 to prevent the upper sash from being lowered and the lower sash from being raised. The security means 20 is installed between an upper transverse portion 14 of the upper sash 12 and an upper transverse portion 15 of the lower sash 13. The security means 20 includes a plurality of interfitting and interlocking bars 21 and 22 locked in position with a fastening means 23. At the lower end of the security means 20 is a metal enclosure 24 for the window lock.

Figure 2:
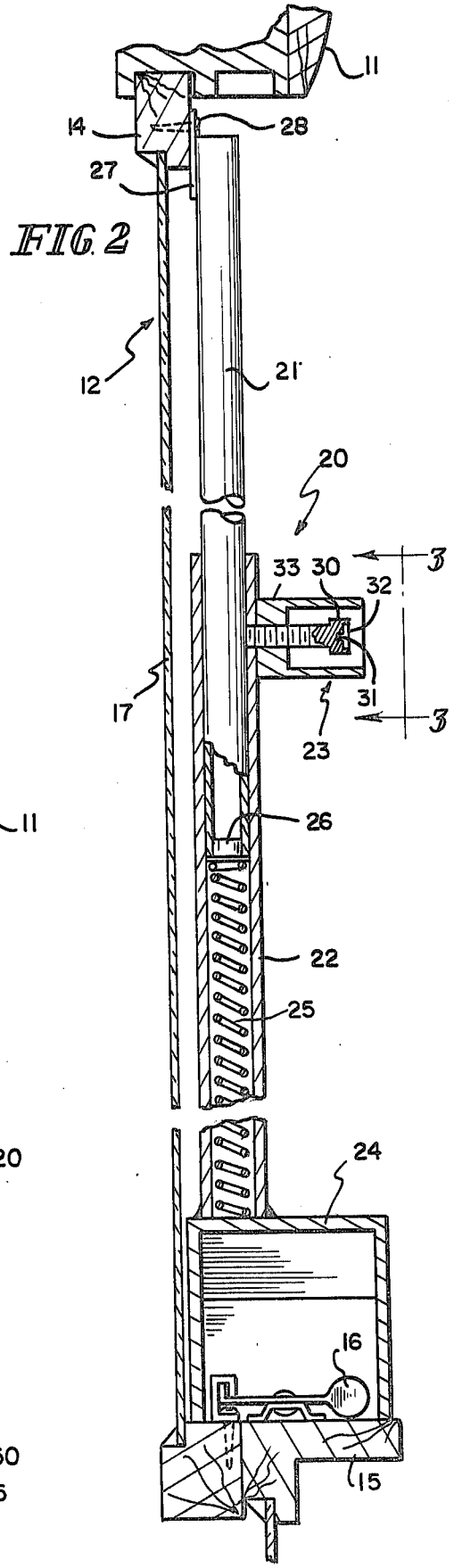
FIG. 2 is a sectional side view of the window and the window security means illustrated in FIG. 1 taken along line 2—2 of FIG. 1.

FIG. 2 is a partial cross-sectional view of the upper portion of window 10 showing in greater detail how security means 20 is constructed and installed to protect the window 10 against opening. In this embodiment of the security means the plurality of interfitting and interlocking bars comprises an upper tube 21 fitted within a lower tube 22 in a telescoping relationship. The fastening means 23 is a shielded slot type screw carried by the lower tube 21 in such a manner that one end bears against and prevents movement of the upper tube 21 as the fastening means 23 is screwed into its fastening position. A compression spring 25 is carried within the lower tube 22 between the metal enclosure 24 and upper tube 21. As shown in FIG. 2, the compression spring 25 bears against a hat plug 26 closing the lower end of the upper tube 21 and can thus urge the tube 21 upwardly.

In installing the window security means 20 in the window 10, the enclosure 24 at the lower end of the lower tube 22 is fitted over the window lock 16. The upper tube 21 is pressed downwardly against the action of the compression spring 25 to adjust the security means 20 to fit between the transverse rail 14 of the upper sash 12 and the transverse rail 15 of the lower sash 13. Means is provided at the upper end of upper tube 21 to permit the upper end of the upper tube to be fastened to transverse rail 14. As shown in FIGS. 1 and 2, such means can be a plate 27 adapted for connection to the transverse rail 14 by means of screws 28. With the means 27 securely fastened to the upper transverse rail 14 of the upper sash 12 and the lower end of the security means securely held in place by the upper transverse rail 15 of the lower sash and the window lock 16, the upper tube 21 and lower tube 22 are secured immovably together by fastening means 23.

Figure 3:
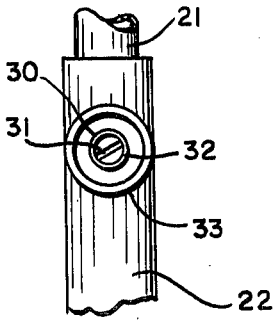
FIG. 3 is a partial view of the fastening means and shield of FIG. 1 and FIG. 2 taken from line 3—3 of FIG. 2.

The fastening means 23 shown in the cross-sectional view of FIG. 2 and the partial view FIG. 3 comprises a shielded slotted screw 30 including a slot 31 to permit engagement by a screwdriver and a skirted portion 32. This arrangement limits operation of the threaded fastener to screwdrivers having blades which fit the slot 31 and within the skirted portion 32, thus preventing operation of fastener 23 by coins and preventing the use of many screwdrivers. In addition, access to the threaded fastener 30 is limited by a shield 33 which is securely attached to the lower tube 22, for example, by welding. Shield 33 includes a cylindrical portion surrounding the threaded fastener 30 and extending outwardly beyond its head to limit access to the threaded fastener 30. The shield 33 can conveniently be threaded to avoid threading the lower tube 22.

The enclosure 24 is securely welded or otherwise attached to the lower tube 22, and the box like enclosure 24 fits over the window lock 16 in such a manner that it cannot be rotated to any substantial degree when in position over the window lock 16. Because box 24 and the lower tube 22 are immovably attached together, the lower tube 22 cannot be substantially rotated and the fastening means 23 cannot be rotated in such a manner that access to the threaded fastener 30 can be obtained from outside the window pane 17 of the window 10 as shown in FIG. 2.

With the upper end of upper tube 21 securely fastened to the upper transverse rail 14 of the upper sash 12, the lower portion of the lower tube 22 securely fastened into position by engagement of the enclosure 24 at its lower end with the lock 16 and the upper transverse rail 15 of the lower sash 13, and with tubes 21 and 22 immovably fastened together by fastening means 23, the window 10 is secured against opening from the outside by the security means 20.

Figure 4:
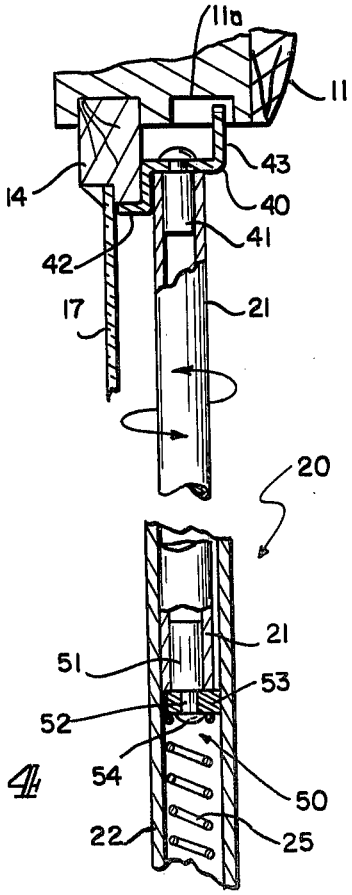
FIG. 4 is a partial view of a cross-section of another embodiment of a window security means of this invention, illustrating a further structure and method for installation.

FIG. 4 illustrates another embodiment of the invention showing modified fastening means and modified means at the top of the upper bar to engage the window. In the embodiment shown in FIG. 4 the upper bar 21 has at its upper end means to engage the window in the form of a bracket 40 fastened by rivet means 41 to the upper end of the upper bar 21. The bracket 40 includes a downwardly depending L-shaped bracket portion 42 to engage the transverse rail 14 of the upper sash of the window. In addition, the bracket 40 is bent to provide an upwardly projecting portion 43 having sufficient length to project within the slot 11*a* formed in the frame of the window into which the transverse rail 15 of the lower sash 13 is intended to fit when the lower sash is raised. The embodiment illustrated in FIG. 4 with means such as bracket 40 eliminates the need to use screws or other fasteners at the upper end of the security means 20 as will be explained.

The embodiment of FIG. 4 also includes at the lower portion of the upper bar 21, a fastening means 50. Fastening means 50 includes a plug 51 carried within the lower end of the upper tube 21 and providing a downwardly depending eccentrically located shaft 52, an eccentric cam 53, and a head means 54 to retain the cam 53 on the shaft 52. The cam 53 has a circular periphery and is free to rotate about the shaft 52. The hole in cam 53 about which it rotates is itself eccentrically located. The distance between the center line of the upper tube and the center line of the eccentric shaft 52 preferably equals the distance between the center of the periphery of the cam and the center of the hole about which the cam rotates. Cam 53 has a diameter equal to the outside diameter of the upper tube 21 and the outside diameters of cam 53 and the upper tube 21 can be coincident. Compression spring 25 bears against cam 53 and the force of spring 25 will hold cam 53 and spring 25 stationary when the upper tube 21 is rotated.

In installing security means such as that illustrated in FIG. 4 the means 40 of the upper end of the security means 20 is placed with the bracket portion 42 engaged against the upper transverse bar 14 of the upper sash and upwardly projecting portion 43 is positioned to extend within the slot 11*a* in the frame of the window 11. Thus positioned, the upper end of the security means 20 may not be dislodged from its position because the means 40 is so designed that upwardly projecting portion 43 of the bar 40 will engage the window frame 11 before the bracket portion 42 disengages from transverse rail 14 of the upper sash 12. Because the means 40 is attached to the upper tube 21 by rivet means 41, tube 21 is free to rotate as indicated in FIG. 4. Upon rotation of the upper tube 21, however, the cam 53 is held stationary by the force of compression spring 25. Since shaft 52 about which cam 53 can rotate is offset from the center line of upper tube 21 and since the periphery of cam 53 is offset from the center line of the hole about which it rotates, rotation of upper tube 21 will force the periphery of cam 53 and the lower end of upper tube 21 against the inner wall of lower tube 22 in such a manner that the upper tube is immovably fastened into position. Although the lower end of the security means is not illustrated in FIG. 4, the lower end of lower bar 22 will include the enclosure means 24 as shown in FIG. 2.

Although the illustrated embodiments are comprised of tubular members, security means of my invention may be formed from other interfitted and interlocking bars, such as U-shaped channels or other such formed members having sufficient structural rigidity. Such bars are preferably of steel, aluminum or other such metallic materials. Such materials may be conveniently joined by welding or brazing or may be adhesively attached or threaded together to form the convenient, easily installed assembly that comprises this invention. The window security means of this invention may be inexpensively made and easily used to provide additional security in homes equipped with double hung casement type windows, or any other type window which opens and closes by sliding sashes within a fixed frame. Although the invention is illustrated with windows that slide vertically, such windows which slide horizontally are available and the security means disclosed above is equally applicable in such windows. Other embodiments may be devised without departing from the spirit and scope of my invention as set forth in the following claims.

I claim:

1. A security means for a double hung casement window and lock comprising:

a lower tube, open at its upper end and having a metal box rigidly fastened to its lower end, said box being open at its bottom and shaped to engage the window lock; an upper tube-telescoped within the upper end of said lower tube and adapted at its upper end to engage the window frame; a fastening means carried by one of said tubes to secure the upper tube and the lower tube immovably together; and a shield surrounding said fastening means and limiting access to said fastening means to essentially one direction, said fastening means and said shield being securely carried on one side of one of said tubes, and said metal box and its engagement with the window lock preventing rotation of the security means and access to the fastening means from outside the window when the security means is fitted to the window.

2. The window security means of claim 1 wherein the shield is a tubular member with a threaded base portion and an outwardly extending cylindrical portion securely attached to one side of the lower tube, and the fastening means is a screw threadedly carried by the shield, said shield and lower tube being adapted to permit the screw to engage the upper tube.

3. The window security means of claim 1 wherein the fastening means includes a rotatable cam carried at the lower end of the upper tube within the lower tube, and a compression spring is carried within the lower tube between the metal box and the cam, the spring being adapted to provide a force preventing the cam from rotating upon rotation of the upper tube when the window security means is installed, the cam engaging the inner surface of the lower tube and forcing the outer periphery of the upper tube against the inner surface of the lower tube in such a manner as to immovably secure the upper tube within the lower tube.

4. The window security means of claim 1 wherein the upper end of the upper tube is adapted to engage the window frame by means of a bracket fastened to the upper end of the upper tube but free to rotate about the center line of the upper tube, said bracket including a downwardly depending portion adapted to engage a sash of the window and an upwardly depending portion adapted to fit within a slot in the window frame; a compression spring is carried within the lower tube between said box and said upper tube; and the lower portion of the upper tube includes a circular cam, having a central hole offset from its center and being carried by and rotating upon a downwardly depending shaft, said shaft being carried in the lower end of the upper tube and offset from the center line of the lower tube, said compression spring preventing rotation of the cam upon rotation of the upper tube so that upon such rotation the cam, shaft and upper tube operate to secure the upper tube within the lower tube.

5. A window security means comprising a plurality of interfitting and interlocking bars with fastening means to lock the bars in a fixed position, one of said bars carrying means connectable to one portion of the window and the other of said bars carrying an enclosure for the window lock, said fastener and said bars being adapted to retain the security means within the window by the means connectable to one portion of the window and by the enclosure engaging the window lock when the fastener is actuated, said enclosure for the window lock being shaped to engage the window lock and prevent rotation of the security means and access to the fastening means from outside the window when the security means is retained within the window.

6. A window security means as set forth in claim 5 wherein the plurality of interlocking and interfitting bars comprise an inner member and an outer member and the fastening means comprises means adjacent the end of one of the members to force the outside of the inner member to bear against the inside of the outer member and prevent the movement of the members along their central axis.

7. A window security means comprising interfitting and interlocking bars including an inner member and an outer member with fastening means to lock the bars in a fixed position, one of said bars carrying means connectable to one portion of the window and the other of said bars carrying an enclosure for the window lock, said fastening means including means adjacent one end of one of the members to force the outside of the inner member to bear against the inside of the outer member and prevent movement of the members along their central axis, a compression spring carried by the outer member and bearing upon the lower end of the inner member, said fastener and said bars being adapted to retain the security means within the window by the means connectable to one portion of the window and by the enclosure engaging the window lock when the fastening means is actuated.

8. A window security means comprising interfitting and interlocking bars including an inner member and an outer member with fastening means to lock the bars in a fixed position, one of said bars carrying means connectable to one portion of the window and the other of said bars carrying an enclosure for the window lock, said fastening means including a threaded member carried on one side of the outer member by a threaded shield member and having an end passing through the outer member to engage the inner member and to force the outside of the inner member to bear against the inside of the outer member and prevent movement of the members along their central axis, said shield inhibiting access to said threaded member except from essentially one direction and said enclosure engaging the window lock to restrict rotation of the outer member, said fastener and said bars being thereby adapted to retain the security means within the window by the means connectable to one portion of the window and by the enclosure engaging the window lock when the fastening means is actuated.

9. A window security means comprising an outer tube with an inner tube telescoped therein, fastening means comprising means adjacent to the end of one of the tubes to force the outside of the inner tube to bear against the inside of the outer tube preventing the relative movement of the tubes along their central axis and locking the tubes in a fixed position, a bent flange rotatably mounted at the upper end of the inner tube and including a downwardly projecting depending portion adapted to engage the window and an upwardly depending portion adapted to engage a slot in the window frame, an enclosure for the window lock carried by the outer tube, said fastening means including at the lower end of the inner tube a rotatable cam adapted to engage the inner surface of the outer tube and force the inner tube into an interfering engagement with the inner surface of the outer tube upon rotation of the inner tube, thereby retaining the security means within the window by the bent flange at the upper end of the inner tube and by the enclosure engaging the window lock.

* * * * *